United States Patent [19]

Albertsen

[11] 4,149,591

[45] Apr. 17, 1979

[54] HEAT EXCHANGE MODULES

[75] Inventor: Peter S. Albertsen, Corning, N.Y.

[73] Assignee: Corning Glass Works, Corning, N.Y.

[21] Appl. No.: 840,586

[22] Filed: Oct. 11, 1977

[51] Int. Cl.[2] ..... F28D 7/02

[52] U.S. Cl. ..... 165/165; 29/157.3 R

[58] Field of Search ..... 164/164, 165, 166, 167; 29/157.3 R

[56] References Cited

U.S. PATENT DOCUMENTS

| | | | |
|---|---|---|---|
| 4,041,591 | 8/1977 | Noll et al. | 165/166 X |
| 4,041,592 | 8/1977 | Kelm | 165/166 X |

*Primary Examiner*—Edgar W. Geoghegan

*Attorney, Agent, or Firm*—John P. DeLuca; Burton R. Turner; Clarence R. Patty, Jr.

[57] ABSTRACT

A modular heat exchange element, adapted to be positioned in fixed relation to one or more other of such modules, may be produced as a monolithic, honeycombed body having a plurality of flow paths therethrough for at least two fluids. The body is provided with a plurality of cells extending from one face end of the body to the other face end thereof and arranged in columns of cells separated by fluid barrier wall surfaces. At least selected columns of cells are closed on both face ends of the body, with inlets and outlets for the selected cells provided by removing portions of the boundary surfaces and fluid barrier walls of the columns of cells near face ends of the body. A first fluid may enter selected columns of cells through the inlets and exit from the outlets near the other end thereof. A second fluid passes through the other selected columns of cells. Another module communicates with said first mentioned module for conveying fluids therethrough via appropriately mated openings therein such that a multiple module heat exchanger may be fabricated. Fluids are applied and passed from the heat exchange device through sealable headers communicating with inlet and outlet openings in selected modules, and module to module communication is accomplished by fluid tight seals.

15 Claims, 10 Drawing Figures

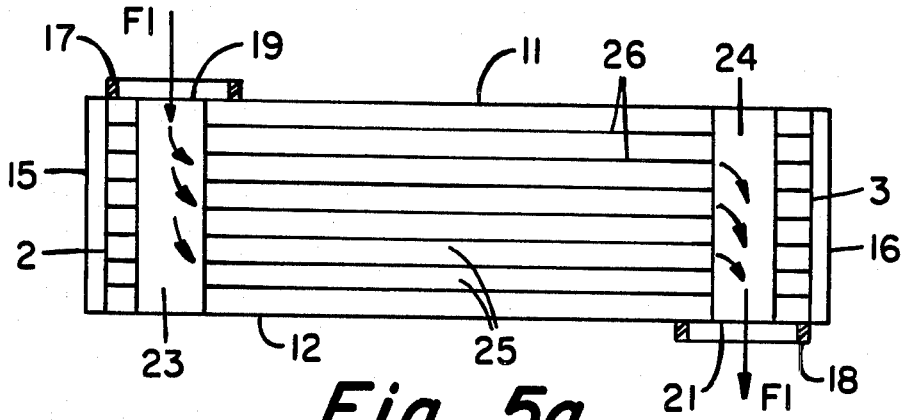
Fig. 5a
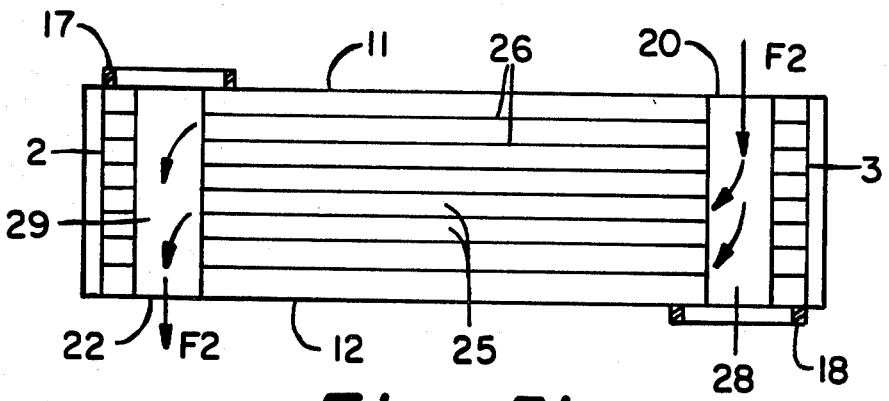
Fig. 5b
Fig. 6
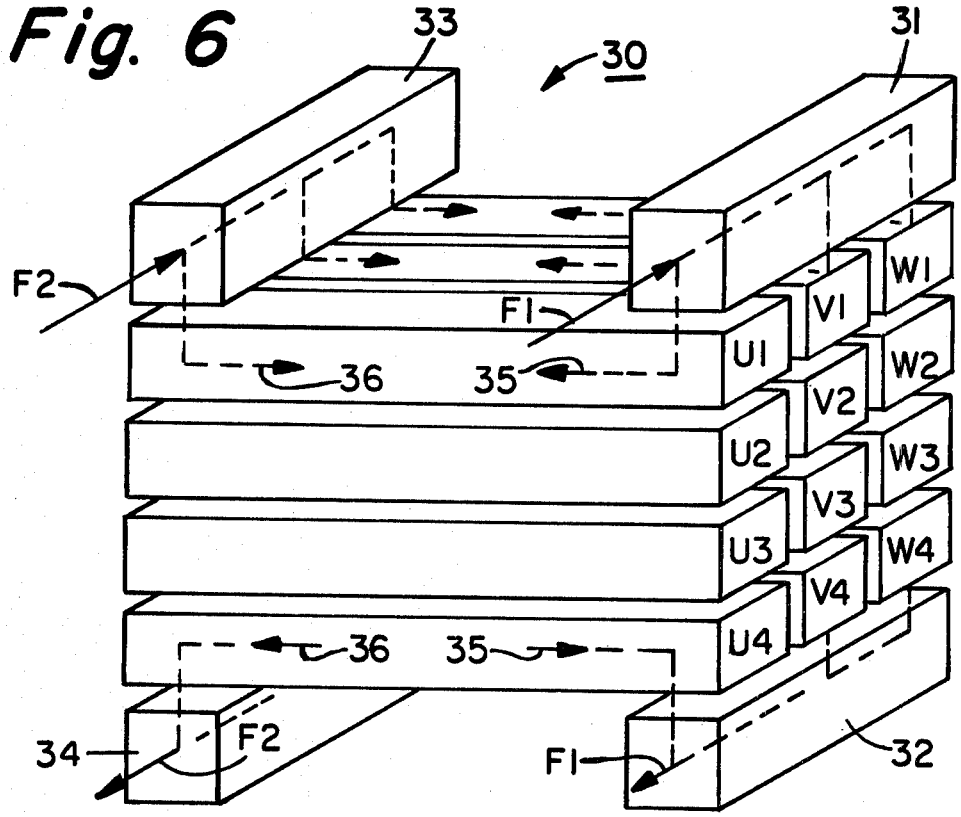

HEAT EXCHANGE MODULES

BACKGROUND OF THE INVENTION

The invention relates to a modular heat exchange device adaptable for use in various chemical processes and heat transfer applications.

A heat exchange device, such as the one described in the patents of Kelm No. 4,041,592, issued Aug. 16, 1977, Ser. No. 660,879, filed June 24, 1976 and Noll et al. No. 4,041,591, issued Aug. 16, 1977, Ser. No. 660,880 filed Feb. 24, 1976 both of which are assigned to Corning Glass Works, the assignee of the present invention, show extruded heat exchanges for use in heat exchange applications of various sorts, and methods for producing same. The devices illustrated in those patents are single units with multiple flow paths. The present invention, a modular unit, can be stacked in a compact structure of given heat exchange surface area with designated flow paths. A number of stacking arrangements are possible depending on the flow path configuration chosen for the module.

Various materials may be used for fabricating the structure of the module including extruded and fired ceramics such as those described in the above-mentioned patents or powdered metals, or mixtures thereof. The honeycombed body need not necessarily be extruded. It is anticipated that casting, welding, machining or other methods of manufacture may be employed to the making of the basis module from any formable material.

The present invention is concerned with heat exchange modules adapted to be mated with other similar modules to produce structure which does not require the use of complex accessories. For example, it is necessary to use means for joining one module to another to form a heat exchanger of the type described herein and further it is necessary to provide inlets and outlets for working fluids thereto. However, it is not necessary to fabricate complicated headers and manifolding with the simplified design of the modular arrangement of the present invention. Furthermore the basic design of the apparatus does not change and is readily adapted for applications of widely diverse technologies of varying complexity. In general, the module of the present invention may be used to produce a simplified structure for a heat exchanger for fluids and the like, a recuperator or after burner system for industrial glasses or other appropriate applications. In addition to heat exchange applications, the module may be used in filtration and osmosis systems when porous materials are used to produce the honeycombed body.

SUMMARY OF INVENTION

There has been provided a module adapted to be positioned in fixed relation to at least one other of such modules to form an exchange structure of selected surface area for at least two fluids, each module being fabricated into a monolithic honeycomb body having a matrix of relatively thin walls defining a multiplicity of cells extending from one face end thereof to another face end thereof, and being bounded on sides generally parallel to cell axes by generally opposed upper and lower boundary surfaces connected by opposed first and second side boundary surfaces, the cells being grouped into a plurality of columns of cells, each column being separated from adjacent columns of cells by fluid barrier wall surfaces extending continuously from the upper boundary surface to the lower boundary surface and from one face end of the honeycombed body to the other face end thereof.

The body is provided with respective inlets and outlets for at least first and second fluids into selected columns of cells by forming openings in at least one upper boundary surface, a lower boundary surface and opposed side boundary surfaces near a selected face end of the body for each respective fluid. Entrance and exit fluid flow grooves are formed from respective inlets and outlets to cells and selected columns of cells by removing portions of cell walls joining opposed fluid barrier wall surfaces near face ends in the selected columns of cells, and at least portions of entrance and exit fluid flow grooves are sealably enclosed to form respectively, inlet and outlet fluid openings, such that fluid flow paths from one module to another may be accomplished from the first and second respective fluid inlet through the cells in selected columns of cells to the respective outlet.

DESCRIPTION OF THE DRAWINGS

FIG. 5*a* is a side sectional elevation of the heat exchange element of the present invention taken along line 5*a*–5*a* of FIG. 2.

FIG. 5*b* is a side sectional elevation of the heat exchange module of the present invention taken along line 5*b*–5*b* of FIG. 2.

FIG. 6 is a perspective view of the heat exchange structure formed from the modular elements of the present invention.

DESCRIPTION OF THE INVENTION

Figure 1:
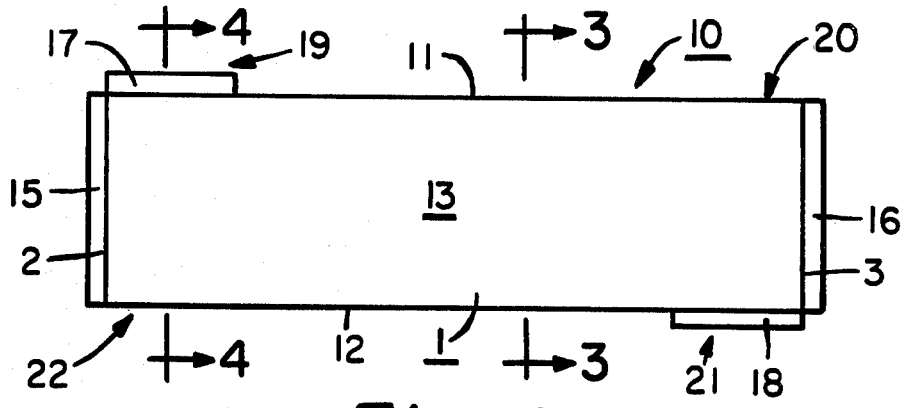
FIG. 1 is a side elevation of the heat exchange module of the present invention.
Figure 2:
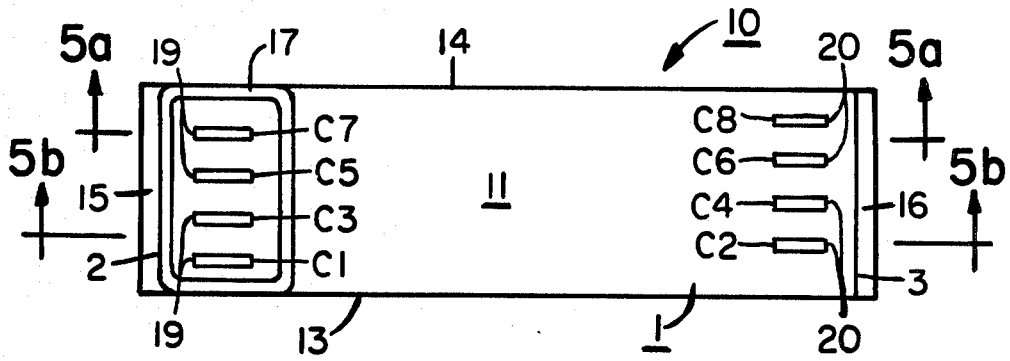
FIG. 2 is a top plan view of the heat exchange module of the present invention illustrating fluid openings in the upper boundary surface and an annular gasket.
Figure 3:
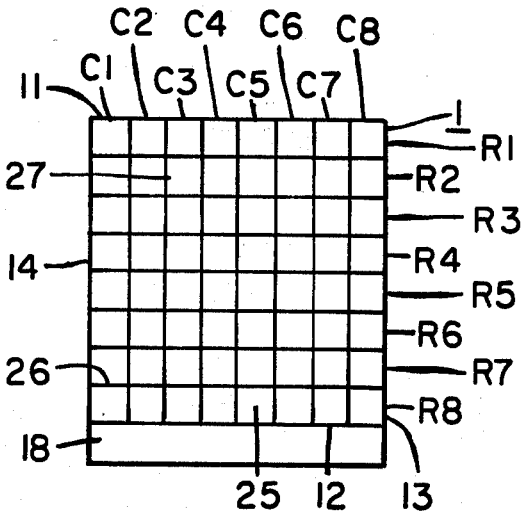
FIG. 3 is a cross sectional elevation of the heat exchange module taken along line 3–3 of FIG. 1.

FIGS. 1 and 2 illustrate respective side and top views of the heat exchange module 10 of the present invention. The heat exchange element 10 is fabricated from an extruded honeycombed body 1 having respective upper and lower boundary surfaces 11 and 12, and respective front and rear, side boundary surfaces 13 and 14. The body 1 is bounded lengthwise by left and right face ends 2 and 3 respectively. Left and right faceplates 15 and 16 respectively close face ends 2 and 3. At least one annular upper gasket 17 is disposed near the left face end 2 of the body 1 and encloses a first set of openings 19 near the said face end 2 on the upper boundary surface 11. A second annular gasket seal 18 is disposed on the lower boundary surface 12 near the right face end 3 and encloses a series of openings 21 in the lower boundary surface 12, which openings are in fluid communication with openings 19. A second series of openings 20 are offset in staggered relation with the openings 19 in upper boundary surface 11. The said openings 20 are located near the right face end 3 opposite that of the openings 19. Another group of openings 22, in fluid communication with openings 20, are located near the left face end 3 of the body in the lower boundary surface 12.

The honeycombed body 1 when viewed in cross section along lines 3–3 of FIG. 1 appears as a series of rows and columns of cells 25 bounded externally by respective upper, lower, right and left side boundary surfaces 11, 12, 13 and 14, and internally by respective horizontal and vertical fluid boundary walls 26 and 27. The columns of cells 25 are designated as C1-C8 while the rows of cells are designated as R1-R8 so that there appears to be a matrix of cells within the body 1. The body 1 may be extruded from a dye of appropriate profile which promotes knitting of the extruded material. The knitting of fluid barrier walls 26 and 27, and the boundary surfaces 11 through 14 prevents voids in the matrix, such that there is no communication of the space from one cell to another.

Figure 4:
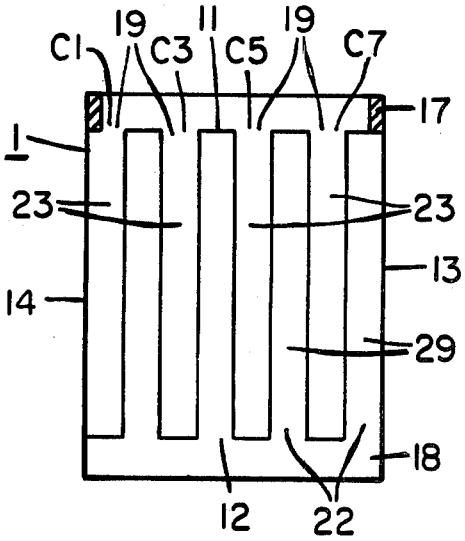
FIG. 4 is an end sectional elevation of the heat exchange element of the present invention taken along line 4–4 of FIG. 1.

Referring to FIGS. 2 and 4 and 5*a* the fluid openings 19 are produced by drilling or cutting slots into selected columns of cells through upper boundary surface 11. The selected columns are C1, C3, C5 and C7. Each of the openings 19 are continued through the horizontal fluid barrier walls 26 in the selected columns and form a flow conduit 23. Openings 21 are similarly produced in the lower boundary surface 12 at the opposite face end 3 of the body 1 and are continued through the horizontal fluid barrier walls 26 in order to form an outlet flow conduit 24. A first fluid F1 may enter through the opening 19 pass through the conduit 23 and through the cells 25 of the selected column of cells (C7 of FIGS. 2 and 4) and then to the outlet fluid conduit 24 and openings 21 in the lower boundary surface 12, in what is known as a Z-flow pattern.

Referring to FIGS. 2, 4 and 5*b* it can be appreciated that a similar arrangement may be constructed for a second fluid F2 which is passed in counterflow with the first fluid F1 illustrated in FIG. 5*a* for a second series of flow channels (column C2 in FIG. 2) beginning with openings 20 near the right face end 3 of the body 1 and into an inlet conduit 28 which is formed in a manner similar to the manner of the formation of the conduits 23 and 24 of FIG. 5*a*. The horizontal fluid barrier walls 26 are removed in alternate columns C2, C4, C6 and C8 so that the second fluid F2 may pass in heat exchange relation with the first fluid F1 flowing through the adjacent odd numbered columns. An outlet conduit 29 is formed when the holes 22 are drilled or cut in the lower boundary surface 12 and horizontal fluid barrier walls 26 near the left face end 2 of the body 1 in the same selected columns C2, C4, C6 and C8. A second fluid flow path may be traced from openings 20 in upper boundary surface 11 of the body near face end 3, through the inlet conduit 28, through the cells 25 in the selected columns C2, C4, C6 and C8, and to the outlet conduit 29 near the other face end 2 of the body, and through the outlet openings 22 in the lower boundary surface 12 thereof.

The formation of the inlets and outlets and conduits for respective fluids may be formed by simply drilling vertical bores in the selected columns of cells through the horizontal fluid barrier surfaces but stopping short so as to not drill through the opposite boundary surfaces. For example, in FIG. 4 the inlet openings 19 for fluid F1 may be drilled vertically through the selected columns C1, C3, C5 and C7 through the upper boundary surface 11 and through the subsequent horizontal fluid barrier walls 26 but terminating above lower boundary surface 12. Similarly the outlet openings 21 at the right face end 3 of the body in the lower boundary surface 12 may be drilled vertically upward through lower boundary surface 12 and subsequent fluid barrier walls 26 in the selected odd numbered columns mentioned above but stopping short so as not to pierce the upper boundary surface 11 of the body for those selected columns. The arrangement is similar for the second fluid path but in alternate even numbered columns and at opposite faces and ends of the body 1. It should be apparent that fluid flow direction is immaterial and selected according to design criteria. Therefore inlet and outlet nomenclature changes with the flow direction chosen.

If another body or number of bodies are prepared in a similar fashion there will be a group of modular heat exchange elements 10 which may be stacked together so that the corresponding inlet openings or inlets 19 for the first fluid can mate with the corresponding outlet openings or outlets 22 of a previously engaged exchanger element 10. It should be realized that the designation for first and second fluid inlet openings 19 and 20 in upper boundary surface 11 and corresponding fluid outlet openings 21 and 22 in lower boundary surface 12 for the respective first and second fluids, F1–F2, is a designation for a particular module in a group of modules. The roles played by the modules immediately following or immediately prior to the particular module in question are reversed so that the first fluid F1 flows through into inlets 19 of a first module 10 through columns C1, C3, C5 and C7 then from outlets 21, thence to inlets 20 of a next lower module (not shown) shifting to the even numbered columns C2, C4, C6 and C8 in such immediately following module, and following said even numbered columns to outlets 22, and thence to inlets 19 in the next subsequent module. The reason for this shift is that the each individual module is a mirror image of the prior one, and as long as segregation of the fluid is maintained it is immaterial which channels the respective first and second fluids flow through in a particular element.

In the embodiment shown annular gaskets 17 and 18 are disposed on respective upper and lower boundary surfaces 11 and 12 near opposite left and right face ends 2 and 3 of the body 1. The gaskets may be integrally formed of the same material as the body 11 or may be a suitable rubber O-ring or other approprite material for effecting the seal. Only one gasket 17 and 18 is required for each respective boundary surface 11 and 12, since a pair of seals 17 and 18 are shared between juxtaposed modular elements, as will be apparent from a discussion of the structure of FIG. 6.

The faceplates 15 and 16 are sealed to the respective left and right face ends 2 and 3 of the honeycombed body 1 such that there is no flow between columns of cells along the face ends 2 and 3. The faceplates 15 and 16 may be formed of the same material as the body or may be some other appropriate material for the particular application which may be fired or welded to produce the required seals.

The arrangement illustrated in FIGS. 1 through 5*a–b* is but one of a plurality of possible configurations for a stackable heat exchanger module. For example, the module 10 is adapted for Z-flow, which lends itself to a vertically stacked structure of horizontal elements as illustrated in FIG. 6. On the other hand if a C-flow pattern were required the openings 19 and 20 would be aligned with each other in the same columns of cells for example C1, C3, C5 and C7 whereas the openings 21 and 22 would be aligned with each other in the immediately adjacent columns of cells namely C2, C4, C6 and C8. Under such conditions the inlets and outlets of at least one of the groups of openings 19 or 20 would be reversed in such a configuration and the modules would be stacked so that the face ends 2 and 3 would be offset relative to the immediately adjacent heat exchange element which can be visualized as a brick wall affect with staggered bricks.

Figure 7:
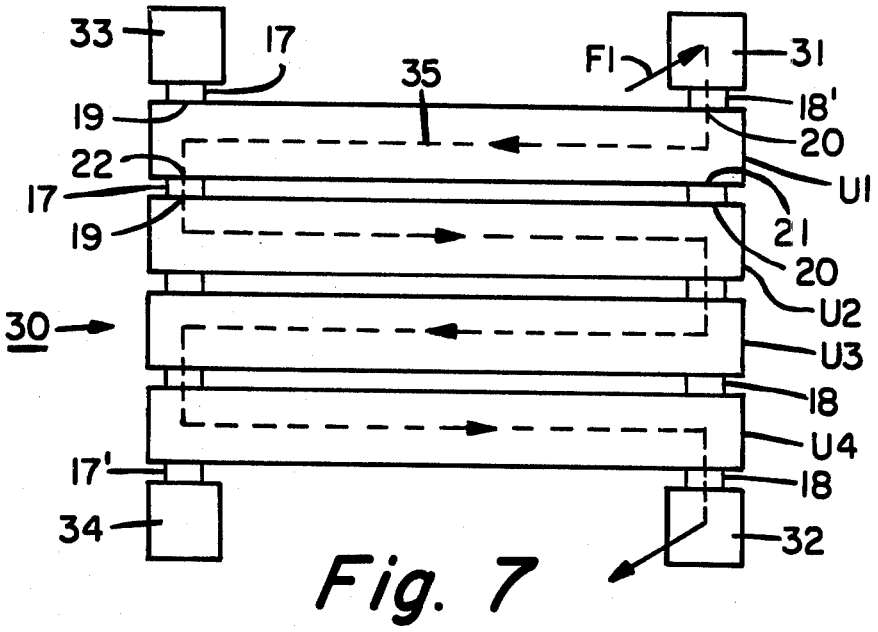
FIG. 7 is a side elevation of the structure illustrated in FIG. 6.
Figure 8:
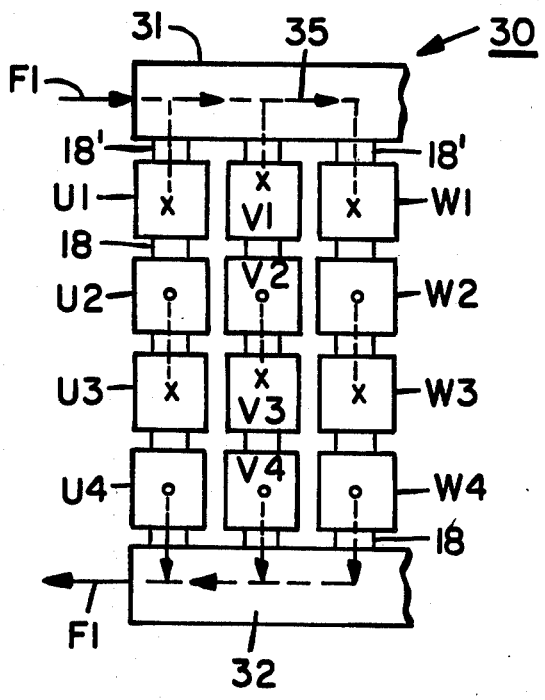
FIG. 8 is an end elevation of the structure illustrated in FIG. 6.

FIGS. 6, 7 and 8 illustrate a heat exchanger 30 wherein two fluids F1 and F2 are passed in counterflow heat exchange relation with one another. An exemplary 4 × 3 heat exchange structure 30 is formed of a matrix of heat exchanger elements U1–U4 through W1–W4. The heat exchange structure 30 includes respective first fluid F1 inlet and outlet headers 31 and 32 and second fluid F2 inlet and outlet headers 33 and 34. Each of the elements U1–U4 through W1–W4 are of the type illustrated in the earlier drawings and described above which are formed with inlets and outlets for the corresponding fluids F1 and F2 in the Z flow configuration. Fluid F1 enters the inlet header 31 which has openings therein mating with inlets for elements in the first row of elements U1, V1, W1, following a path for each respective column of elements U1–U4, V1–V4, and W1–W4 as illustrated by the broken line 35 (see also FIGS. 7 and 8). In the elements U1, V1 W1, flow F1 progresses from right to left towards a corresponding outlet in a lower boundary surface of the respective elements, and so on to an inlet for each of the elements U2, V2, and W2, then from left to right in the second row of elements, and thence on to the respective third and fourth rows of elements to outlet header 32 as illustrated in FIGS. 7 and 8. Similarly, as shown in FIG. 6, fluid F2 enters header 33 and flows into elements U1, V1, W1, progressing as illustrated from entrance openings at the left end of elements U1, V1 and W1, and thence from right to left following broken line 36 on to the second row of elements U2, V2, W2 and so on through the rows of elements to outlets in the elements U4, V4, W4 in communication with outlet header 34.

The flow for fluid F1 is best illustrated in FIGS. 7 and 8. Inlet header 31 is coupled via seal 18' to opening 20 of element U1 (see also FIG. **5*b*). Fluid F1 is transported from right to left and through outlet 22 of element U1 and via seal 17 of element U2 to inlet 19 thereof (see also FIG. 5*a*). The fluid flow proceeds from left to right in the element U2 to outlet 21 of U2 and via seal 18 to element U3 and so on (see broken line 35). The annular seal 17 and 18 are as illustrated in FIG. 1, namely one each of said seals may be integral with the body 1 and lie near opposite face ends at opposite boundary surfaces for sharing with juxtaposed elements. The seal elements 17' and 18' couple respective headers 31 and 34 to elements U1 and U4** as illustrated. They may be separate "O ring" gaskets or integral with either of the headers or elements which share them.

FIG. 8 illustrates the end view of the arrangement of FIG. 6 with (X's) representing flow into the plane of the page and points (.) representing the flow out of the plane of the page. FIG. 8 especially illustrates the combination series and parallel flow for the fluids F1 and F2. For example the fluid F1 enters header 31 and via each seal 18' simultaneously enters the elements U1, V1 and W1. The fluid F1 flows along the elements mentioned above in parallel (into page) and thence flows into each of the next succeeding elements U2, V2 and W2 and so on serially for each column u1–U4, V1–V4 and W1–W4, leaving the lowermost respective ones in each row of elements U4, V4, W4 to enter the exit header 32, as a combined flow.

It is possible to fashion appropriately formed headers 31–34 with separate chambers such that the fluid F1 passes into header 31 for serial flow through elements U1–U4 and thence on to header 32 to communicate in series with elements V1–V4 and again through header 31 and so on exiting at a rearward end of the header 31.

Figure 9:
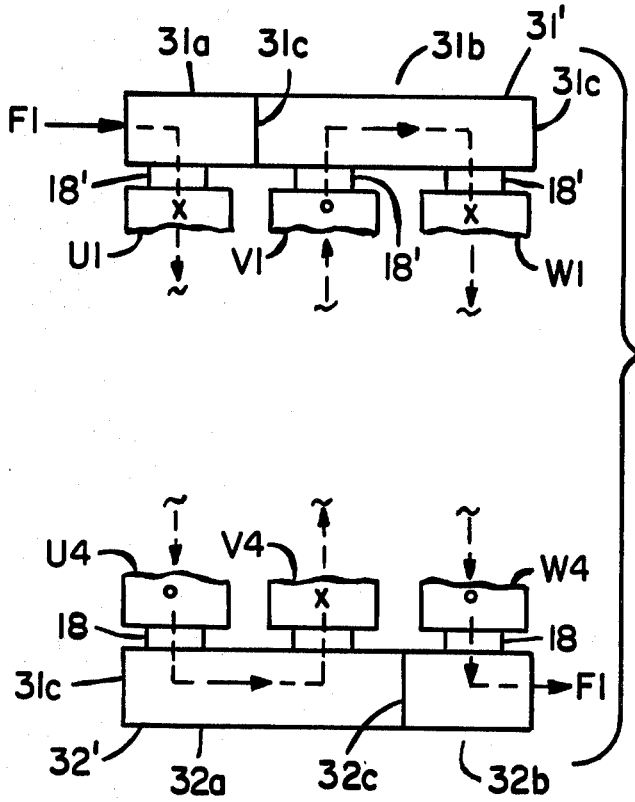
FIG. 9 is a partially fragmented side elevation of an alternate embodiment of the present invention.

This concept is illustrated in FIG. 9 wherein a partially fragmented end view of an alternative embodiment with all series flow is shown. The elements U1–U4 through W1–W4 are the same as previously described. Headers 31' and 32' are each formed with respective elements **31*a*–31*b* and 32*a*–32*b*, having respective face barrier walls 31*c*–32*c* and so on for each header 31–32 such that fluid flow in the header is restricted. For the total series flow (X's and points's (.) indicate flow into and out of the page plane as noted above). The fluid F1 enters the header 31' at the left most end thereof of element 31*a* which is in communication with the element U1 via seal 18'. The fluid F1 is transported along the element U1, in accordance with the principles discussed above with respect to FIGS. 6 through 8, following its way to the end of element U4 illustrated in the drawing. At this point the fluid F1 flows into the header 32*a* via the seal 18 and from left to right towards the element V4. This occurs because the face barrier walls 32*c* prevent the flow in any other direction. The fluid F1 carries itself through the elements in the column V4 through V1 and thence to the header 31*b* via the seal 18'. Again the fluid flow is restricted to entrance only into the element W1 via the seal 18' because of the presence of the face barrier wall 31*c*. The fluid F1 follows the course set out in the elements W1 through W4 and enters the exit chamber 32*b* of header 32'** as illustrated.

Headers 33' and 34' and respective elements **33*a–b* and 34*a–b* thereof (not shown) for fluid F2, corresponding to the headers 31*a–b* and 32*a–b* for fluid F1, are arranged at the opposite end of the heat exchanger to form the transitions necessary to permit the fluid F2 to traverse the stacked heat exchanger elements in a similar fashion, so that the fluids F1 and F2** each pass serially through the heat exchanger apparatus in counterflow relation to one another.

Other possible flow arrangements are available with the heat exchanger modules described herein, however the arrangement illustrated in FIG. 6 is a preferred practical approach to the two fluid problem.

The Z flow pattern illustrated herein appears to provide the most versatile type of flow arrangement. It is possible to use C, I, or combinations thereof for flow patterns, as illustrated in U.S. Pat. No. 4,041,592 which is incorporated herein by reference. The heat exchanger elements of the present invention may also be utilized with the various sealing arrangements featured in U.S. Pat. No. 4,041,591, incorporated herein by reference.

While there has been described what are presently considered to be the preferred embodiments of the present invention it should be obvious to those skilled in the art that various changes and modifications may be made therein without departing from the invention, and it is intended in the appended claims to cover any such changes and modifications as fall within the true spirit and scope of the invention.

I claim:

1. A modular heat exchange module adapted to be positioned in fixed relation to at least one other of such modules to form a heat exchange structure of selected surface area for at least two fluids comprising:

a monolithic, honeycombed body having two opposed face ends and a matrix of thin walls forming a multiplicity of substantially parallel cells extending therethrough, the body being bounded on sides generally parallel to cell axes be opposed first and second boundary surfaces and opposed third and fourth boundary sufaces connecting said first and second boundary surfaces, the cells in the body being grouped into a plurality of columns of cells, each column being separated from adjacent columns of cells by a first opposed fluid barrier wall surface extending continuously from the first boundary surface to the second boundary surface and each cell in the column being separated from another adjacent one therein by second opposed barrier wall surfaces extending from the third to fourth boundary surface across said barrier wall surface, each of said first and second mentioned fluid barrier wall surfaces extending from one face end of the honeycombed body to the other face end thereof, and each face end of said body being closed against fluid passage, the honeycombed body having openings in the first and second boundary surfaces and first barrier wall surfaces, into at least first and second selected adjacent alternate columns of cells forming associated fluid flow conduits, each of said conduits extending from an associated one of the openings to another associated one of the openings in at least one of the first and second boundary surfaces between opposed first fluid barrier wall surfaces in the selected columns of cells, thereby providing in the body, first and second fluid flow paths extending from near one face end of the body through the boundary surface openings and first fluid barrier walls, via the fluid flow conduit to cells in the selected columns of cells, and from the cells in the selected columns of cells through the first fluid barrier wall surfaces and through the associated boundary surface openings via the fluid flow conduit near the other face end of the honeycombed body;

means sealably fixed to the honeycombed body for communicating at least one of the respective first and second fluid flow conduits to a respective fluid flow conduit of the honeycombed body of at least one other of said modules; and means sealably fixed to the honeycombed body in communication with at least one of said first and second openings for providing inlets and outlets for respective first and second fluid flow paths.

2. A method of fabricating a modular multiple flow path heat exchanger element for a heat exchange structure constructed from a plurality of such modular elements, each having a plurality of contiguous flow paths extending therethrough for separate fluid flow, the method comprising the steps of:

providing a plurality of honeycombed bodies, each having a matrix of relatively thin walls defining a multiplicity of open-ended cells extending from one face end thereof to another face end thereof and being bounded on exterior sides generally parallel to cell axes by generally opposed first and second boundary surfaces connected by first and second side boundary surfaces, the cells being grouped into a plurality of columns of cells, each column being separated from adjacent columns of cells by a first opposed fluid barrier wall surface extending continuously from the first to second boundary surface and each cell being separated from other adjacent cells in the column by second opposed fluid barrier walls extending from the third to fourth boundary walls and across the first mentioned fluid barrier walls and each of said fluid barrier walls extending from the one face end of the honeycombed body to the other face end thereof, providing entrance and exit openings for a first and a second fluid into selected respective adjacent columns of cells and exits for the first and second fluids out of the respective selected adjacent columns of cells by forming respective openings in at least one of the first boundary surface and the second boundary surface, forming entrance and exit fluid flow conduits for the first and second fluids from entrance and exit openings, respectively, to cells in selected columns of cells by removing portions of cell walls joining opposed fluid barrier wall surfaces in the selected columns of cells, sealably closing face ends of the body to fluid flow, and sealably forming means at the entrances and exits to form, respectively, entrance and exit fluid flow coupling seals for the first and second fluids for communication of said first and second fluids with respectively selected components of another of such modular elements, such that first and second fluid flow paths are respectively formed from the respective fluid flow entrance coupling seals to exit coupling seals via the first and second fluid entrance openings, the respective entrance fluid flow conduit, through the cells in selected columns of cells, to the respective exit fluid flow conduit and the first and second fluid exit openings.

3. The method as recited in claim 2 further comprising the step of: sealably joining at least exit fluid flow conduits of one body, for the first and second fluids, to respective entrance fluid flow conduits of at least another body.

4. The method as recited in claim 3 further comprising the step of: forming inlet and outlet conduits for each of said first and second fluids for communication with respective entrances of the one body and exits of the other body.

5. The method of claim 2 wherein the respective entrances and exits and fluid conduits for the first and second fluids are provided in alternate columns of cells.

6. The method of claim 5 wherein the entrances, exits and fluid flow conduits in the first and second fluids are provided in opposite boundary surfaces and fluid barrier walls near opposite ends of the honeycombed body so that Z flow paths are formed.

7. The method of claim 2 wherein the matrix of thin wall cells form a regular array of cells having substantially parallel axes.

8. The method of claim 2 wherein the honeycombed body has a rectangular cross-section.

9. The method of claim 2 wherein sealably forming means at the entrances and exits to form fluid flow couplings comprises forming an integral annular seal about at least one of the entrances and exits for one of the fluids for mating with associated entrances and exits of a contiguous module.

10. The method of claim 2 wherein the entrance and exit openings and fluid flow conduits are formed in said body such that at least one of U-Z-I and C flow patterns are produced.

11. A modular heat exchange device adapted for use with other such modules for fabrication of an array of such modules into a heat exchanger for a plurality of fluids comprising:

a monolithic, honeycombed body having a matrix of thin walls forming a multiplicity of substantially parallel cells extending therethrough and being bounded on exterior sides generally parallel to cell axes by opposed upper and lower boundary surfaces and first and second side boundary surfaces, said cells being grouped into a plurality of columns and row of cells, each column and row being separated from adjacent columns and rows of cells by respective opposed fluid barrier wall surfaces extending continuously from the upper boundary surface to the lower boundary surface and from the first side boundary surface to the other side boundary surface, said fluid barrier wall surfaces extending from one face end of the honeycombed body to another face end thereof, selected portions of columns and rows of cells being closed against fluid passage on both face ends of the honeycombed body, said honeycombed body having openings adjacent one end formed in the upper boundary surface, and through respective opposed fluid barrier wall surfaces, extending between said side boundary surfaces, into the selected columns and rows of cells forming fluid flow conduits for a first fluid openings adjacent the other end of said honeycombed body formed in the lower boundary surface and through respective opposed fluid barrier wall surfaces extending between said side boundary surfaces and communicating with said fluid flow conduits for said first fluid; separate but similar fluid flow conduits for a second fluid formed in said honeycombed body intermediate the fluid conduits for said first fluid, said fluid flow conduits for each fluid extending from one of the openings in an upper boundary surface to another associated one of the openings in a lower boundary surface through and between openings in opposed respective common opposed fluid barrier wall surfaces in the selected columns and rows of cells, thereby providing in the body fluid flow paths through said honeycombed body corresponding to the respective fluid flow conduits, means sealably fixed to the honeycombed body for communicating at least one of a respective first and second fluids to an associated respective one of the openings in the boundary surfaces of the honeycombed body; and means sealably fixed to the honeycombed body for recovering the respective first and second fluid from at least one of the respective associated openings in the boundary surfaces thereof.

12. The modular heat exchanger of claim 11 wherein the means sealably fixed to the honeycombed body comprises an annular seal about at least one of the entrance and exit openings.

13. The modular heat exchanger of claim 12 wherein said annular seal is integral with the body and at least one each is disposed on opposite boundary surfaces near opposite face ends of the body surrounding the said one of the entrance and exit openings.

14. The modular heat exchanger of claim 13 wherein each module is a duplicate of another and stacked such that opposite boundary surfaces and annular seals resemble a mirror image of a next previous and subsequent module in the stack.

15. A heat exchanger module comprising, an extruded ceramic honeycomb structure having bounding wall portions enclosing a plurality of cells extending longitudinally therethrough from one end to another, said plurality of cells being separated one from another by a plurality of boundary walls extending longitudinally through said structure from one end to another and between opposing bounding wall portions to form columnar rows of cellular conduits through said structure, means sealing off first and second opposite end portions of said cellular structure, first inlet passage means formed adjacent the first end of said honeycomb structure and second outlet passage means formed adjacent the second end thereof communicating with a first set of said columnar rows of cellular conduits extending through said structure providing a first fluid passageway through said structure, second inlet passage means formed adjacent said second end of said honeycomb structure and second outlet passage means formed adjacent the first end thereof communicating with a second set of columnar rows of cellular conduits extending through said structure providing a second fluid passageway through said structure, said columnar rows of cellular conduits in said first set alternating transversely across said honeycomb structure with the columnar rows of cellular conduits of said second set, and means for sealing said inlet and outlet passageways with passageways of adjacent modules.

* * * * *